US008544921B2

(12) United States Patent
Giampieri et al.

(10) Patent No.: US 8,544,921 B2
(45) Date of Patent: Oct. 1, 2013

(54) GRIPPING ELEMENT OF A BAG FOR PHARMACEUTICAL PRODUCTS

(75) Inventors: Simone Giampieri, Polverigi (IT); Federico Ricavi, Corinaldo (IT)

(73) Assignee: AEA S.r.l., Rosora (IT)

( * ) Notice: Subject to any disclaimer, the term of this patent is extended or adjusted under 35 U.S.C. 154(b) by 0 days.

(21) Appl. No.: 12/874,258

(22) Filed: Sep. 2, 2010

(65) Prior Publication Data

US 2011/0059832 A1 Mar. 10, 2011

(30) Foreign Application Priority Data

Sep. 2, 2009 (IT) ..... BO2009A0563

(51) Int. Cl.
*B66F 19/00* (2006.01)

(52) U.S. Cl.
USPC ..... 294/214; 294/26

(58) Field of Classification Search
USPC ..... 294/2, 86.4, 213, 214, 219, 81.56, 294/62, 15, 26; 604/174–180; 60/131; 132/133; 248/99, 231.85, 68.1, 74.1; 269/3, 269/6, 43, 45, 95; 211/12, 85.15; 222/93, 222/105, 475
See application file for complete search history.

(56) References Cited

U.S. PATENT DOCUMENTS

| | | | | |
|---|---|---|---|---|
| 2,116,386 | A * | 5/1938 | Copeland | 211/85.15 |
| 3,861,630 | A * | 1/1975 | Ady | 248/100 |
| 3,935,883 | A | 2/1976 | Stach et al. | |
| 4,355,639 | A * | 10/1982 | Di Salvo | 604/247 |
| 4,675,019 | A * | 6/1987 | Bellhouse et al. | 604/408 |
| 4,994,021 | A * | 2/1991 | Smith et al. | 604/6.04 |
| 5,308,335 | A * | 5/1994 | Ross et al. | 604/141 |
| 5,431,201 | A | 7/1995 | Torchia et al. | |
| 6,045,097 | A | 4/2000 | Gaffar | |
| 8,087,633 | B2 * | 1/2012 | Vargo | 248/441.1 |
| 2005/0242122 | A1 | 11/2005 | Dyer | |
| 2008/0015956 | A1 * | 1/2008 | Regard | 705/28 |

FOREIGN PATENT DOCUMENTS

| | | |
|---|---|---|
| EP | 1779830 | 5/2007 |
| JP | 4006024 | 1/1992 |
| WO | 2007053709 | 5/2007 |
| WO | 2007121437 | 10/2007 |
| WO | 2008012596 | 1/2008 |

* cited by examiner

*Primary Examiner* — Stephen Vu
(74) *Attorney, Agent, or Firm* — Lieberman & Brandsdorfer, LLC

(57) ABSTRACT

A gripping element of a bag for pharmaceutical products is provided with two gripping devices adapted to withhold two opposite edges of the bag itself.

7 Claims, 5 Drawing Sheets

GRIPPING ELEMENT OF A BAG FOR PHARMACEUTICAL PRODUCTS

The present invention relates to a gripping element of a bag for pharmaceutical products.

In particular, the present invention relates to a gripping element of a bag for pharmaceutical products comprising a first edge provided with at least one inlet duct for accessing the content of the bag and a second edge opposed to the first edge itself.

BACKGROUND OF THE INVENTION

The gripping element of the type described, for example, in international patent application WO-2008012596-A2 comprises two substantially flat gripping jaws hinged to each another to turn one with respect to the other about a given fulcrum axis between a clamping position and a releasing position of the aforesaid inlet duct and/or first edge.

The gripping elements of the known type described above have some drawbacks mainly deriving from the fact that such gripping elements are shaped to withhold the bag at only one of the two edges, they can correctly withhold the bag only when the second edge, i.e. the free edge, is arranged underneath the first edge, and therefore they do not allow to tip the bag and withhold it with the second edge over the first edge.

SUMMARY OF THE INVENTION

It is an object of the present invention to provide a gripping element of a bag for pharmaceutical products which is free from the above-described drawbacks and which is simple and cost-effective to be implemented.

According to the present invention, a gripping element of a bag for pharmaceutical products is provided as claimed in the attached claims.

BRIEF DESCRIPTION OF THE DRAWINGS

The present invention will now be described with reference to the accompanying drawings, which illustrate a non-limitative embodiment thereof, in which.

DETAILED DESCRIPTION OF THE INVENTION

Figure 1:
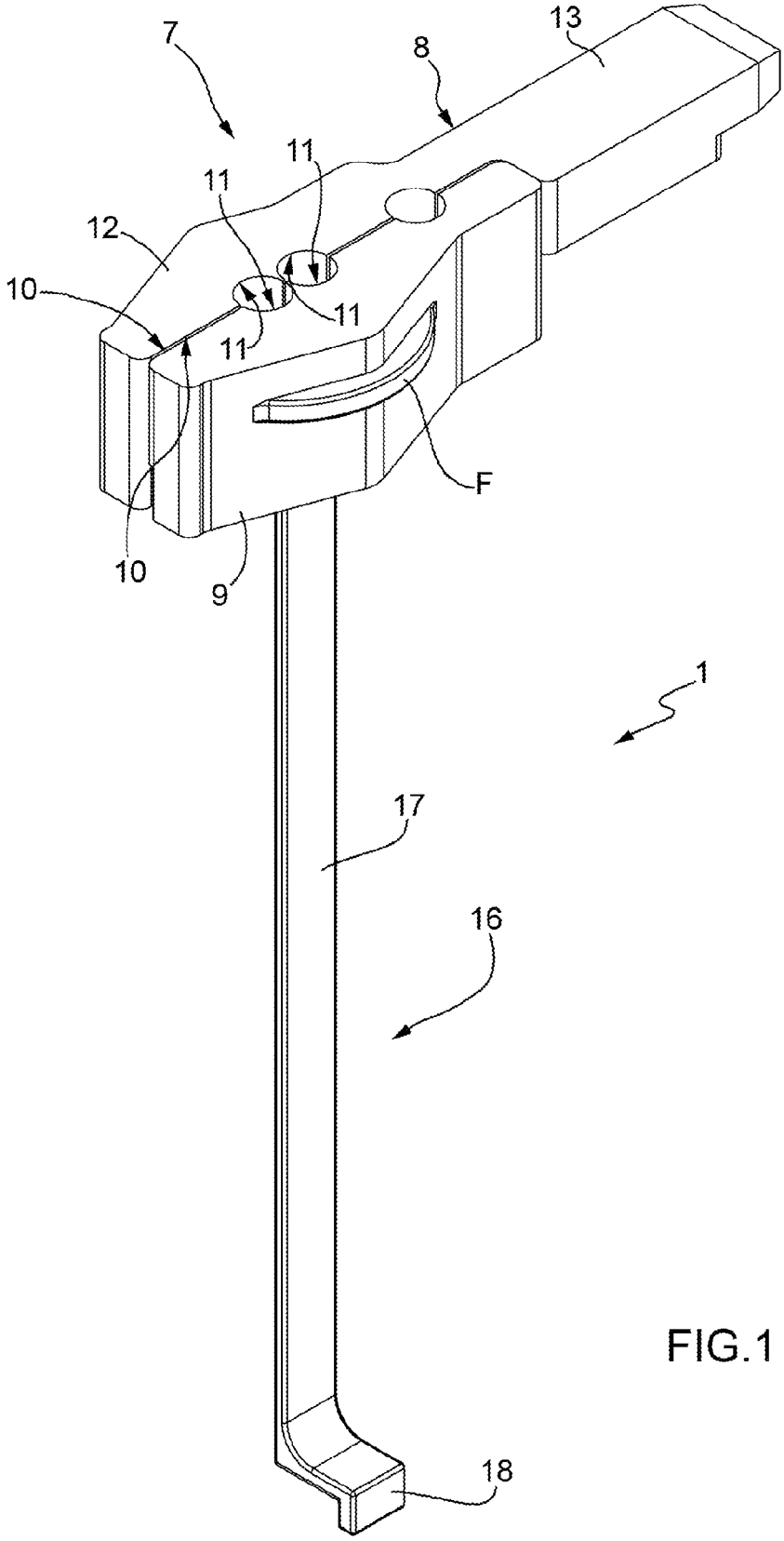
FIG. 1 is a diagrammatic perspective view of a preferred embodiment of the gripping element according to the present invention.
Figure 2:
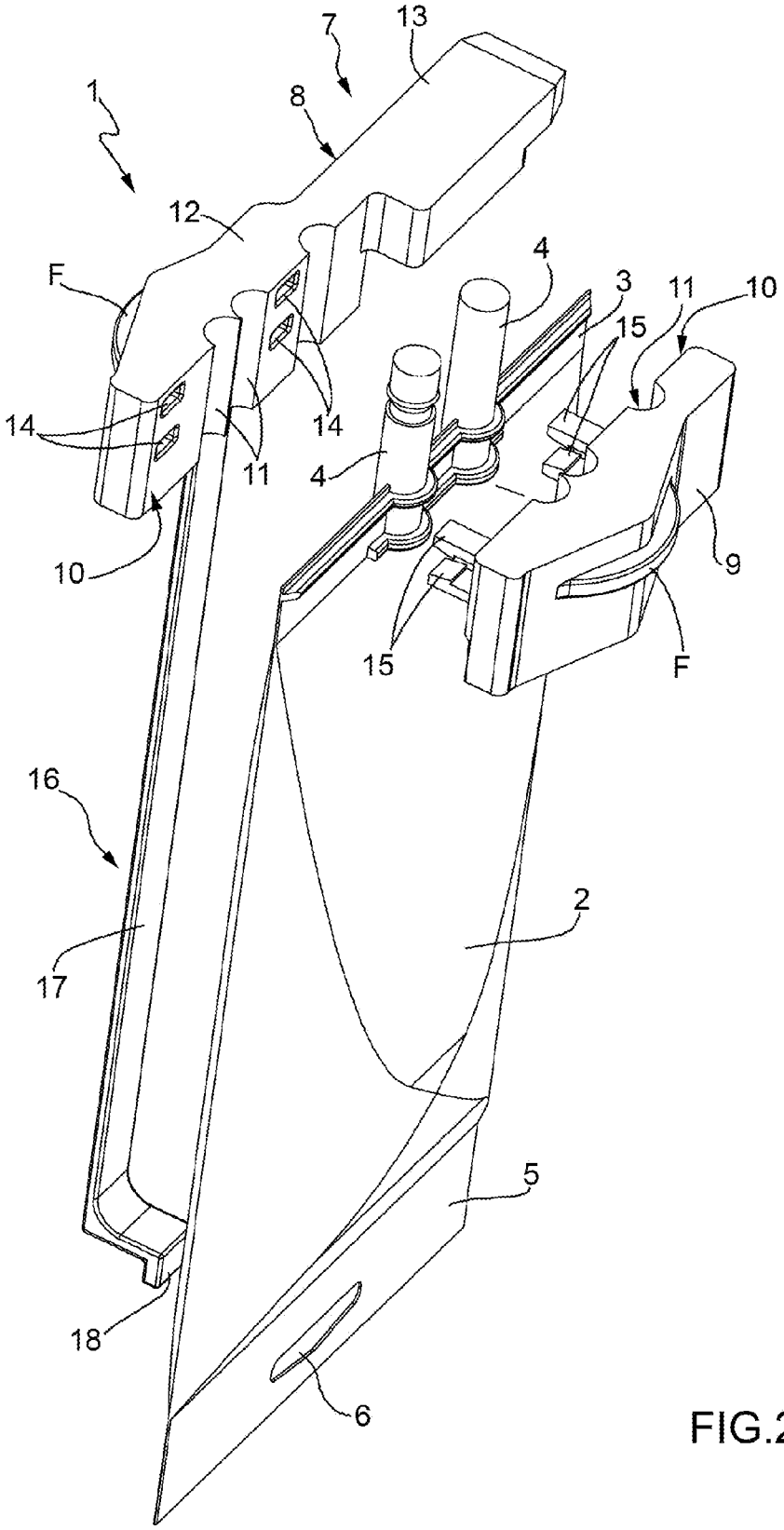
FIG. 2 diagrammatically shows in exploded perspective view the gripping element in FIG. 1 and a bag for pharmaceutical products.

With reference to FIGS. 1 and 2, numeral 1 indicates, as a whole, a gripping element normally used in a machine for preparing pharmaceutical products of the type described, for example, in international patent application WO-2008012596-A2 entirely incorporated herein as reference.

The gripping element 1 is adapted to withhold a bag 2 of pharmaceutical products having a first, substantially flat edge 3 provided, in the case in point, with two inlet ducts 4 to access the content of the bag 2, and a second, substantially flat edge 5, opposed to the edge 3, and provided with an opening 6 obtained through the edge 5 itself.

The gripping element 1 comprises a first gripping device 7, which is adapted to withhold the edge 3 and/or the ducts 4, and comprises, in turn, two substantially flat shaped jaws 8, 9, each of which is made in one piece separate from the other jaw 8, 9, is limited by a substantially flat face 10 facing, in use, the face 10 of the other jaw 8, 9, and has a plurality of substantially semi-cylindrical cavities 11 (three cavities 11, in the case in point) obtained on the face 10 to receive the ducts 4.

Jaw 8 is longer than jaw 9, comprises a coupling portion 12 coupled in use to the jaw 9 and a coupling portion 13 with a seat of a store (not shown), and is provided, in the case in point, with four slots 14, which open outwards at the respective face 10, and are each adapted to receive and withhold a respective tooth 15 which protrudes from the jaw 9 perpendicular to the respective face 10, and is blocked by fitting inside the respective slot 14.

Jaw 9 and portion 12 are each provided with a respective coupling flange F to a robotic handler (not shown), while portion 13 is provided with a coupling element (not shown) of the gripping element 1 to the mentioned seat of the store (not shown).

The gripping element 1 further comprises a second gripping device 16, which is adapted to withhold the edge 5, and comprises, in turn, a rigid elongated bracket 17, which is substantially L-shaped, it protrudes from the jaw 8 transversally from the jaw 8 itself, and has a free end defining a hook 18 adapted to engage the opening 6 of the edge 5 itself.

From the above, it derives that the shape of the gripping element 1 allows to withhold the bag 2 both at edge 3 and at edge 5, and thus allows to orient the bag 2 both in horizontal position and in a vertical position, wherein the edge 3 is arranged over the edge 5 and the ducts 4 are faced upwards, and in a vertical position, wherein the edge 3 is arranged underneath the edge 5 and the inlets 4 are faced downwards.

According to some variants not shown:

jaws 8, 9 are hinged to each another to turn with respect to each other between the clamping and the releasing position;

hook 18 is eliminated and replaced by at least one pliers 23 and 24 gripping element movable between a clamping position and a releasing position of the edge 5.

hook 18 is eliminated and replaced by at least one pliers gripping element movable between a clamping position and a releasing position of the edge 5.

Figure 3:
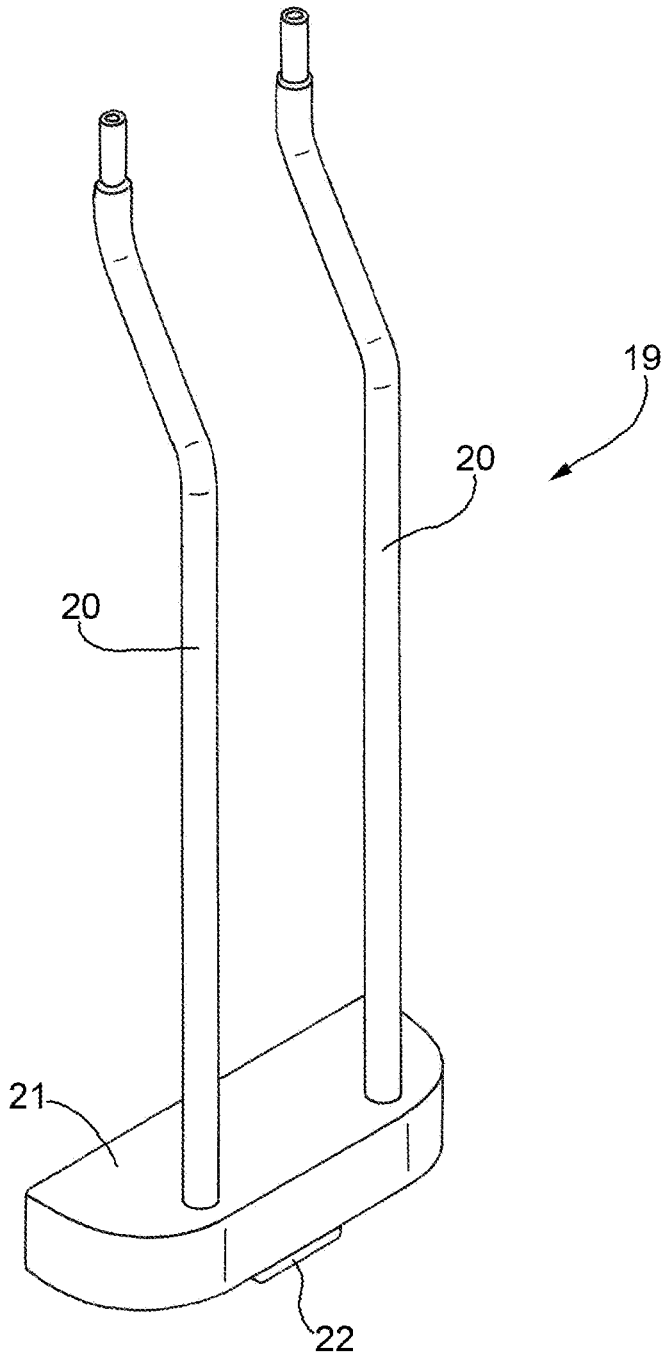
FIG. 3 is a diagrammatic perspective view of a variant of a detail of the gripping element in FIGS. 1 and 2.
Figure 4:
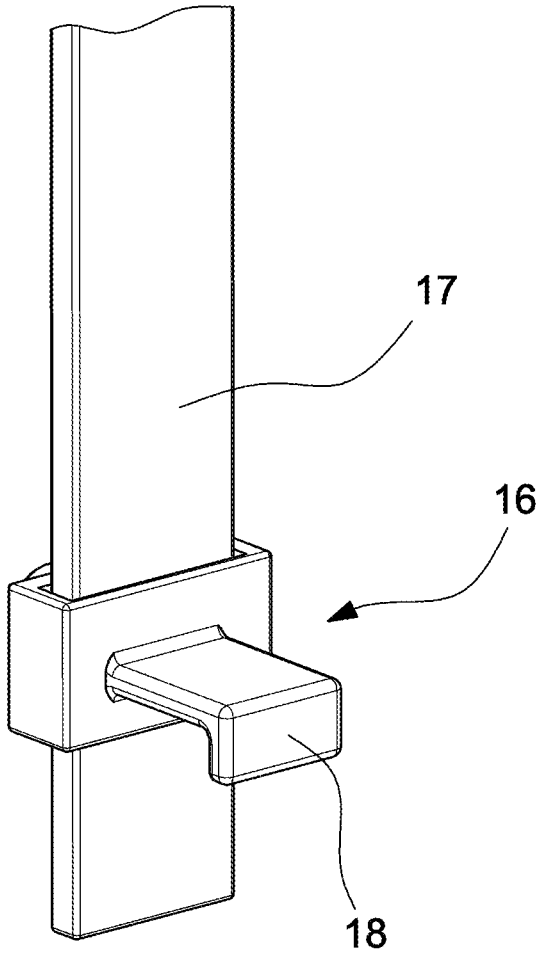
FIG. 4 is a perspective view showing a second gripping element in the form of a hook relatively movable with respect to the bracket.
Figure 5:
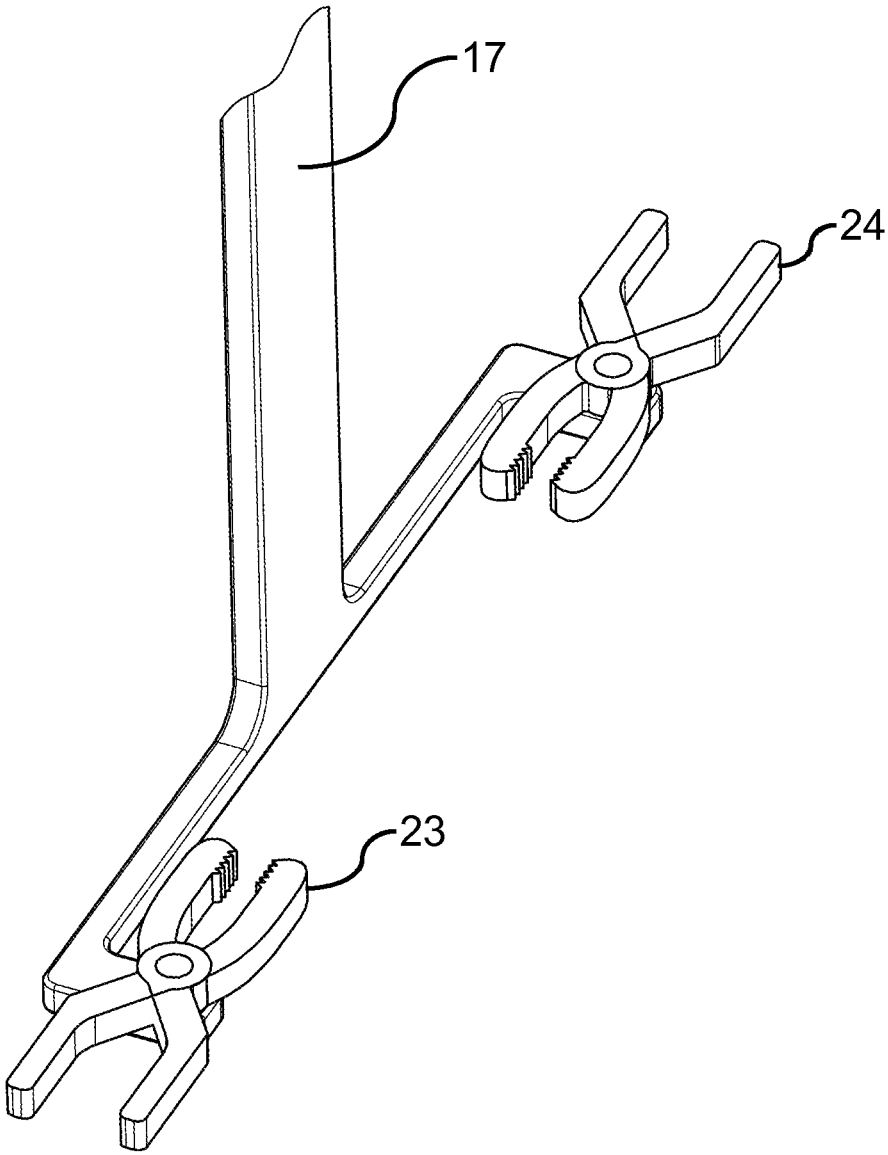
FIG. 5 is a perspective view showing a second gripping device according to a second embodiment of the invention, the second gripping device including first and second plier gripping elements movable with respect to each other.

In the variant shown in FIG. 3, the gripping device 16 is eliminated and replaced by a gripping device 19 comprising two respectively parallel guiding rods 20, which protrude from one of the jaws 8, 9, and are slidably engaged by a substantially flat resting plate 21, which extends transversally to the rods 20, is locked along the rods 20, e.g. by means of at least one locking screw (of the known type and not shown), is arranged so as to allow the edge 5 to wind about the plate 21, and is provided with a hook 22, which protrudes from the plate 21 from opposite side of the bag 2, and is adapted to engage the opening 6 of the edge 5 itself.

Finally, it is worth noting that the gripping element 1 may be either disposable or reusable and may be sterilized either individually or along with the bag 2 and the content thereof.

We claim:

1. A gripping element of a bag for pharmaceutical products, the bag comprising a first edge provided with at least an inlet duct to the bag itself, and a second edge opposed to the first edge, the gripping element comprising:

a first gripping device adapted to withhold the first edge and the inlet duct; and a second gripping device adapted to withhold the second edge, wherein the first gripping device comprises a pair of gripping jaws mobile between a clamping position and a releasing position the first edge and the inlet duct; and wherein the gripping jaws consist of two separate, distinct parts, a first part is provided with at least one tooth and a second part is provided with at least one slot adapted to receive and withhold the tooth.

2. The gripping element according to claim 1, wherein the gripping jaws are mutually hinged to rotate one with respect to the other around a given fulcrum axis; locking means being provided for locking the gripping jaws in the clamping position thereof.

3. The gripping element according to claim 1, wherein the second gripping device comprises at least one hook element adapted to engage an opening obtained through the second edge.

4. The gripping element according to claim 1, wherein the second gripping device comprises at least one pliers element mobile between a clamping position and a releasing position of the second edge.

5. The gripping element according to claim 1, wherein the first and second gripping devices are mobile with respect to each other to selectively control a distance thereof according to the size of the bag.

6. The gripping element according to claim 1, wherein the second gripping device comprises a supporting plate provided with gripping means of the second edge; the bag winding about the supporting plate to allow the second edge to engage the gripping means.

7. The gripping element according to claim 6, comprising at least one guide slidably engaged by said supporting plate.

* * * * *